US005314096A

United States Patent [19]

Fesl et al.

[11] Patent Number: 5,314,096

[45] Date of Patent: May 24, 1994

[54] DUAL PURPOSE PUMP FOR PRESSURE VESSELS

[75] Inventors: Robert Fesl, Leutenbach; Helmut Stelzmüller, Neuhausen; Peter Janssen, Fellbach-Öffingen, all of Fed. Rep. of Germany

[73] Assignee: Alfred Karcher GmbH & Co., Winnenden, Fed. Rep. of Germany

[21] Appl. No.: 923,993

[22] PCT Filed: Mar. 8, 1991

[86] PCT No.: PCT/EP91/00435

§ 371 Date: Nov. 13, 1992

§ 102(e) Date: Nov. 13, 1992

[87] PCT Pub. No.: WO91/14508

PCT Pub. Date: Oct. 3, 1991

[30] Foreign Application Priority Data

Mar. 22, 1990 [DE] Fed. Rep. of Germany ..... 4009231

[51] Int. Cl.[5] ..... B65D 83/00

[52] U.S. Cl. ..... 222/401; 366/244

[58] Field of Search ..... 222/401, 394, 400.8, 222/402, 233-235, 385; 366/102, 103, 104, 242, 244, 245, 247

[56] References Cited

U.S. PATENT DOCUMENTS

| | | | |
|---|---|---|---|
| 1,189,271 | 7/1916 | McCaslin | 222/401 X |
| 1,189,932 | 7/1916 | Garber | 222/401 |
| 1,467,951 | 9/1923 | Rosenberger | 222/235 X |
| 1,718,567 | 6/1929 | Lange | 222/235 X |
| 1,733,724 | 10/1929 | Downs | 366/244 X |
| 1,770,611 | 7/1930 | Grauman | 222/235 X |
| 2,609,973 | 9/1952 | Bullock | 222/401 |
| 2,959,358 | 11/1960 | Vork | 222/235 X |
| 3,091,372 | 5/1963 | Tidd | 222/401 |
| 3,606,094 | 9/1971 | Mills et al. . | |
| 4,089,441 | 5/1978 | Cole et al. . | |
| 4,154,367 | 5/1979 | Hanson et al. | 222/401 X |
| 4,537,334 | 8/1985 | Spengler et al. | 222/401 |
| 4,880,146 | 11/1989 | Hudgins | 366/247 X |
| 5,094,543 | 3/1992 | Mursa | 222/572 X |

FOREIGN PATENT DOCUMENTS

| | | |
|---|---|---|
| 0268921 | 11/1987 | European Pat. Off. . |
| 0320619 | 11/1988 | European Pat. Off. . |
| 340801 | 3/1984 | Fed. Rep. of Germany . |
| 8420572 | 7/1984 | Fed. Rep. of Germany . |

*Primary Examiner*—Kevin P. Shaver
*Attorney, Agent, or Firm*—Barry R. Lipsitz

[57] ABSTRACT

A dual purpose pump for pressure vessels comprises a piston pump disposed within a pump cylinder. The piston pump is arranged in the interior of the pressure vessel and actuatable from the outside by piston strokes for building up an increased pressure in the interior of the vessel. The pump cylinder is mounted on the vessel and projects into the interior thereof. The present invention simplifies mixing, e.g. the preparation of an emulsion, by rotatably mounting the pump cylinder about its longitudinal axis. To accomplish this, a drive mechanism may be mounted on he outside of the vessel for rotating the pump cylinder and the pump cylinder takes mixing elements along with it which project into and thereby mix the liquid during rotation.

12 Claims, 3 Drawing Sheets

DUAL PURPOSE PUMP FOR PRESSURE VESSELS

BACKGROUND OF THE INVENTION

The invention relates to a pressure vessel for spraying a liquid comprising a piston pump arranged in the interior of the pressure vessel and actuatable from the outside by piston strokes for building up an increased pressure in the interior of the vessel and having a pump cylinder mounted on the vessel and projecting into the interior of the vessel.

Such pressure vessels are known from European published patent application 268 921 A2, German published patent application 34 08 015 and German utility model 23 20 572.

These pressure vessels serve, for example, to spray a decontamination liquid, and the pressure required for the spraying is generated in the pressure vessels on the spot by actuating the piston pump.

Mixtures of different liquids which are produced before the spraying, for example, in the form of emulsions are often also sprayed with such pressure vessels. With known pressure vessels of this kind, it is standard practice to open these and in the open state to mix the liquids in the desired manner with one another with the aid of a separate stirring tool and, in the given case, produce the emulsion. The pressure vessel is then closed and brought to the internal pressure required for the spraying by actuating the piston pump.

This is a complicated procedure; also when aggressive liquids are used, there is the danger that these liquids will escape from the vessel into the environment during the mixing operation. The object of the invention is to so improve a generic pressure vessel that the mixture required for the spraying can be produced in a simple way and the pressure required for the spraying can be generated subsequently.

SUMMARY OF THE INVENTION

This object is accomplished in accordance with the invention in a pressure vessel of the kind described at the beginning by the piston pump being mounted on the vessel for rotation about its longitudinal axis, by a drive means for rotating the pump cylinder being arranged on the outside of the vessel, and by the pump cylinder taking along with it as it rotates mixing elements which project into the liquid. The entire pump is thus additionally used as a drive means for mixing elements with which the necessary mixing is carried out in the interior of the closed vessel by rotation of the pump.

It is particularly advantageous for the drive means to be a hand crank; in other cases, however, the driving could also be effected with the aid of a mounted electric motor or via a driving belt coupled with a belt pulley.

If a hand crank is used, it is expedient for it to be simultaneously designed as pump handle so that the same handle can be used to bring about both the rotation for the mixing and the pumping movement for generating the spraying pressure.

In a first preferred embodiment, provision is made for the pump cylinder itself to carry the mixing elements. This results in a particularly simple design.

For example, the pump cylinder according to a preferred embodiment may carry essentially radially protruding mixing blades which extend around it in helical configuration. These helical mixing blades convey liquid from the bottom of the pressure vessel upwards so that it is ensured that chemicals collecting at the bottom of the vessel are uniformly mixed in with the rest of the liquid and when the vessel is emptied at the bottom, a homogeneous mixture is discharged and not liquid which without these mixing blades would collect at the bottom of the vessel.

This effect can be further improved by ring-shaped mixing elements being held on the pump cylinder concentrically with the axis of rotation thereof at the bottom end.

It is also particularly advantageous that mixing can also be carried out when the vessel is under pressure as the rotary bushing for the pump cylinder has, of course, to be of pressure-tight design. Therefore, even after a short interruption in the spraying, it is possible for mixing to be carried out briefly again prior to the next spraying cycle in order to ensure that a homogeneous mixture is sprayed.

While the embodiment described so far requires a bushing which seals the pump cylinder also as it rotates relative to the pressure vessel, such a seal which comes into contact with moving parts can be dispensed with in a modified embodiment in which the mixing elements are mounted for rotation in the pressure vessel and in which the pump cylinder is in take-along engagement with the mixing elements. For, it is then possible for the mixing to be carried out before the pressure vessel is sealed in a pressure-tight manner. Only after termination of the mixing operation is the pump cylinder brought into a sealed position in which there is then no longer any provision for mixing movement.

The take-along engagement is preferably effected in the form of a plug-in coupling.

It is particularly expedient for the pump cylinder to be mounted in the pressure vessel for displacement in the axial direction, with the take-along engagement existing at least in a first position pulled out of the pressure vessel, and for the pump cylinder to be sealed from the pressure vessel in a second position pushed into the pressure vessel. In such an embodiment, the mixing is carried out when the pump cylinder is pulled out, i.e., in a state in which the pressure vessel is not yet sealed tight. After termination of the mixing operation, the pump cylinder can be pushed into the sealed, second position in which the pressure build-up is then possible.

It is expedient for the pump cylinder to be supported in the first position by a removable stop which prevents displacement of the pump cylinder into the second position. This stop is preferably formed by at least one holder which is pivotable into the path of displacement of the pump cylinder and may, for example, be of bow-shaped design.

Furthermore, it is particularly advantageous for the pump cylinder to be screwed in a sealed manner into the pressure vessel in the second position.

BRIEF DESCRIPTION OF THE DRAWINGS

The following description of preferred embodiments serves in conjunction with the drawings to explain the invention in further detail. The drawings show.

DESCRIPTION OF THE PREFERRED EMBODIMENTS

Figure 1:
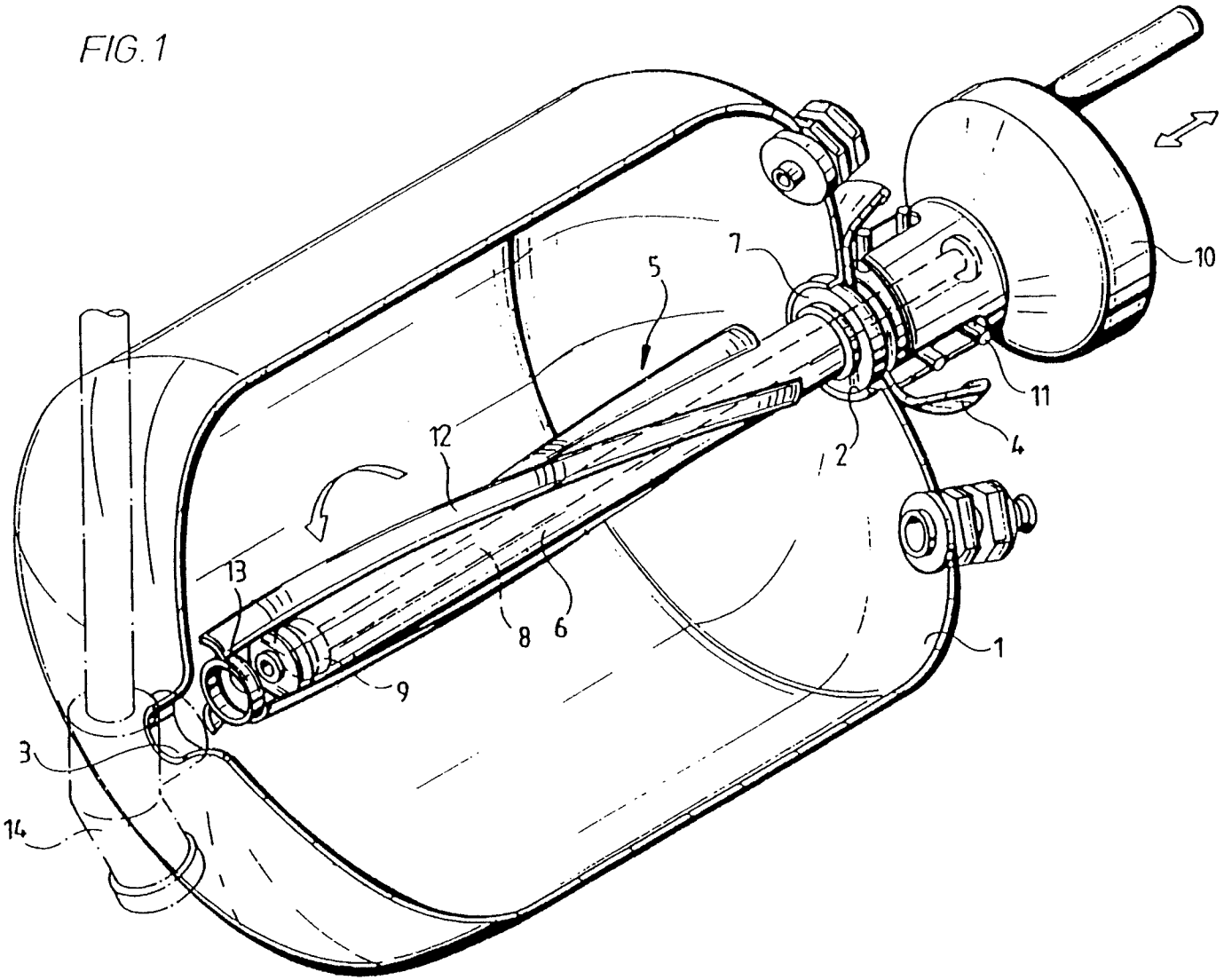
FIG. 1 a perspective illustration of a first preferred embodiment of a broken-open pressure vessel with a piston pump which is rotatable about the longitudinal axis and is provided with mixing blades.

The pressure vessel 1 illustrated in FIG. 1 has a central opening 2 at the top and also a central opening 3 at the bottom. An outlet pipe illustrated only in dot-and-dash lines in the drawing is connected to the opening 3 at the bottom. A piston pump 5 can be inserted in a sealed manner in the opening 2 at the top which is designed as a feed opening and for this purpose is provided with a funnel-shaped enlargement 4.

This piston pump 5 comprises a pump cylinder which extends as far as the bottom of the pressure vessel 1 and by means of a gasket 7 which surrounds it is fixable in an axially immovable and sealed manner in the top opening 2. The gasket 7 enables rotation of the pump cylinder 6 about its longitudinal axis.

In the interior of the pump cylinder 6 there is a piston 9 which is periodically movable up and down via a rod 8, as is generally known from air pumps. The piston 9 is movable up and down via the rod 8 by means of a handle 10 which is arranged on the outside of the pressure vessel 1. In this way, the pressure in the interior of the pressure vessel can be increased so far that liquid contained in the vessel can be let off under pressure via the bottom opening.

The handle 10 is designed as a crank and in the pushed-in position is rotationally fixedly connected to the pump cylinder 6 via radially protruding pins 11 of the pump cylinder 6 so that when the crank-type handle 10 is rotated, the entire pump is rotated about the longitudinal axis of the pump in the opening 2.

Essentially radially protruding mixing blades 12 are arranged on the outside of the pump cylinder 6, thereby surrounding it in helical configuration and extending over the entire height of the pump cylinder. At their lower end, these carry a common mixing ring 13 which is arranged concentrically with the longitudinal axis of the pump and opposite the bottom opening 3.

When the pump cylinder 6 is rotated by the handle 10, the mixing blades 12 stir the liquid contained in the pressure vessel and mix the constituents of this liquid uniformly. This mixing is furthered by the special shape of the mixing blades which convey the liquid constituents from the bottom to the top of the pressure vessel. In particular, the mixing ring 13 ensures that no liquid remains stationary at the bottom of the pressure vessel so that when liquid is let off through the bottom opening 3, a homogeneous liquid mixture is always issued if the liquid has been previously stirred in the described manner.

The piston pump thus fulfils a double function: With it an increased pressure can be generated in the conventional manner in the interior of the vessel and, at the same time, when the vessel is closed, rotation of this piston pump 5 makes it possible for the constituents of the liquid to be mixed uniformly and, if desired, for emulsions to be produced, without the necessity for a separate tool.

Of course, the mixing blades can also be of different design, for example, they can be spaced at greater radial distances from the pump cylinder than is the case in the described embodiment shown in the drawing.

Figure 2:
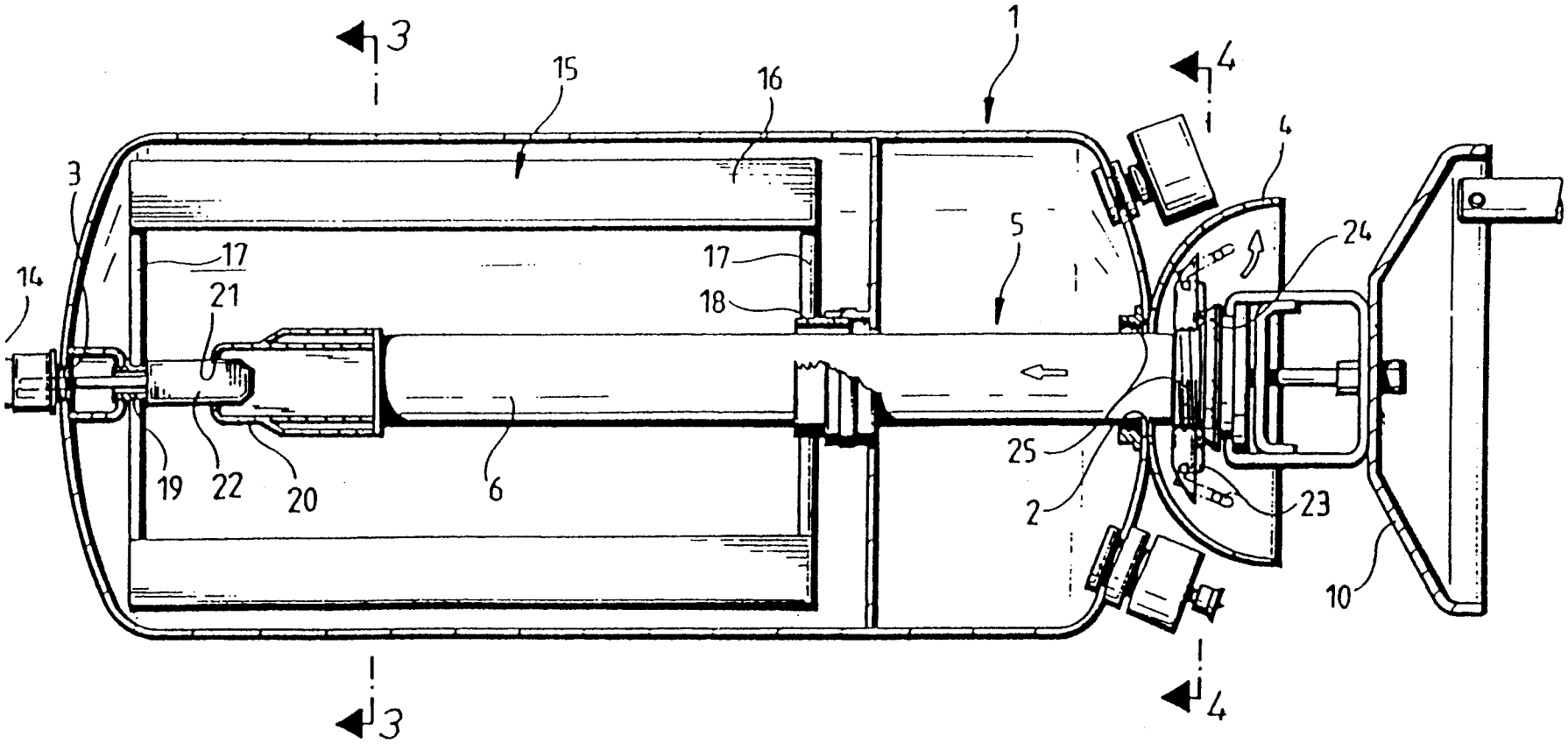
FIG. 2 a longitudinal sectional view through another preferred embodiment of a pressure vessel.
Figure 3:
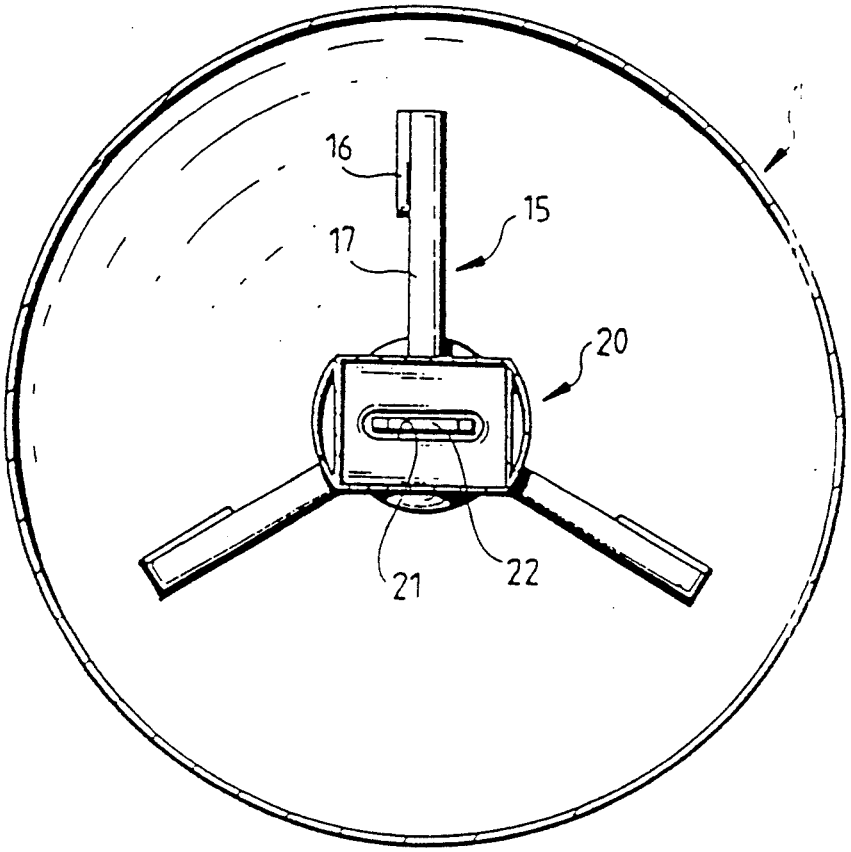
FIG. 3 a sectional view along line 3—3 in FIG. 2.
Figure 4:
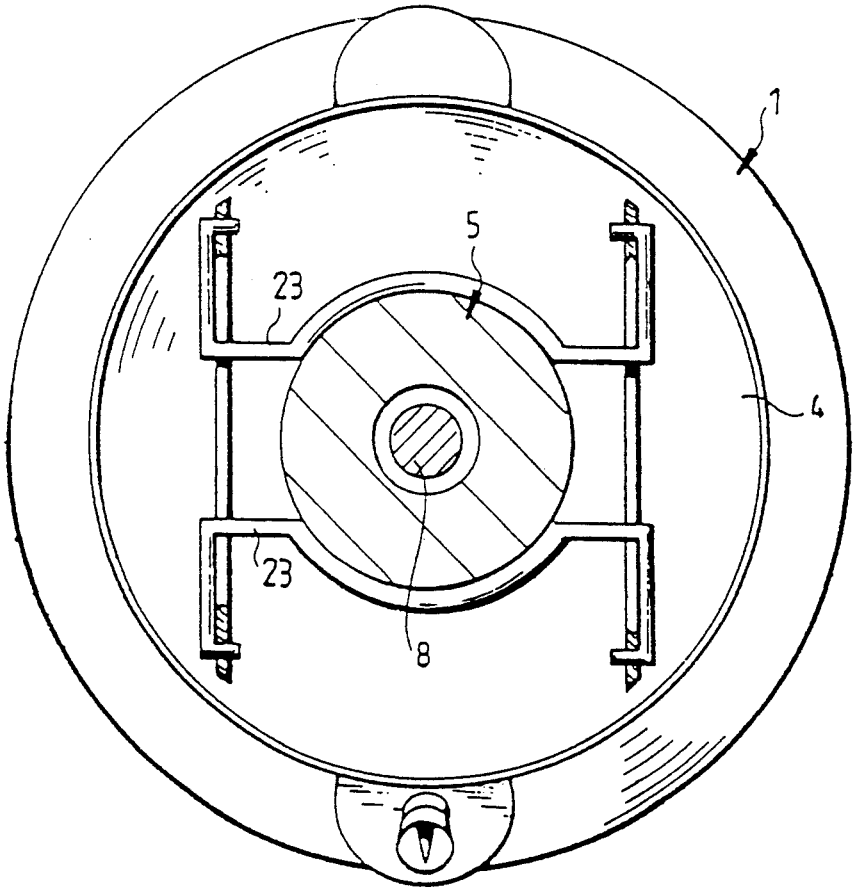
FIG. 4 a sectional view along line 4—4 in FIG. 2.

The modified embodiment illustrated in FIGS. 2 to 4 is of similar design; corresponding parts, therefore, bear the same reference numerals.

Differently from the embodiment of FIG. 1, in this embodiment no mixing elements are held directly on the pump cylinder 6 but instead a mixing element 15 is mounted in the pressure vessel for rotation about its longitudinal axis. In the illustrated embodiment, this consists of three vertical bars 16 which are offset through 120 degrees in relation to one another and are each connected via corresponding radial arms 17 to a bearing bushing 18 and 19, respectively. These bearing bushings are mounted on bearings fixed on the pressure vessel.

The pump cylinder 6 is mounted on the pressure vessel for displacement in the axial direction and thereby extends, for example, through the upper bearing bushing 18. At its lower end, the pump cylinder carries a sleeve-shaped coupler 20 which has a slotted opening 21 on its lower end face. This embraces a coupling element 22 of approximately rectangular cross-section which is rotationally fixedly connected to the mixing element 15 so that the coupler 20 and the coupling element 22 form a plug-in coupling which brings the pump cylinder 6 and the mixing element 15 into take-along engagement. When the pump cylinder 6 is rotated about its longitudinal axis, the mixing element 15 is also rotated accordingly. The plug-in coupling establishes this take-along engagement even when the pump cylinder is in a different axial position, i.e., the pump cylinder can be displaced in the axial direction in relation to the mixing element without the take-along engagement being released. However, if the pump cylinder is pulled very far out of the pressure vessel, the take-along engagement can be released. It is thus possible to pull the pump cylinder —for example, for cleaning purposes—completely out of the pressure vessel.

In the region in which the take-along engagement is maintained, the pump cylinder can be displaced between two positions, namely between a first position (illustrated in FIG. 2) pulled slightly out of the pressure vessel and a second position pushed completely into the pressure vessel.

In the first position, the pump cylinder 6 is fixable by bow-shaped holders 23 which are pivotably mounted on the outside of the pressure vessel and can be pivoted into the path of displacement of the pump cylinder in such a way that the pump cylinder is supported with a collar 24 on these holders 23. In this position, the pressure vessel is not sealed tight. The take-along engagement with the mixing element 15 is established so that in this position it is possible to rotate the mixing element 15 via the pump cylinder by turning the handle 10 and thus produce the desired mixture.

Once this has taken place, the holders 23 can be pivoted out again (illustrated in dot-and-dash lines in FIG. 2). It is then possible to bring the pump cylinder into the pushed-in, second position in which it is screwable into the pressure vessel by means of a suitable threaded connection 25. This screw connection is pressure-tight and so the pressure vessel is thereby sealed in a pressure-tight manner. In this second position, the pump cylinder is no longer rotatable relative to the pressure vessel, i.e., no more mixing can take place. On the other hand, this does, however, also mean that a pressure-tight rotary bushing can be dispensed with as the pump cylinder is no longer rotatable relative to the pressure vessel in the sealed state.

We claim:

1. A dual purpose pump for pressure vessels used for mixing and spraying a liquid, comprising:

a piston pump mounted in an interior portion of said pressure vessel;

said piston pump including a pump cylinder projecting into said interior of said pressure vessel, said pump cylinder being rotatable about a longitudinal axis thereof;

means for actuating said piston pump from the outside of said pressure vessel, said actuating means providing piston strokes to said piston pump for building up an increased pressure in said interior of said pressure vessel;

drive means for rotating said pump cylinder from the outside of said pressure vessel; and a mixing element operatively connected to, and rotatable with said pump cylinder, said mixing element projecting into said liquid for mixing same.

2. The apparatus of claim 1, wherein said drive means is a hand crank.

3. The apparatus of claim 2, wherein said hand crank is formed as a pump handle.

4. The apparatus of claim 1, wherein said mixing element is affixed to said pump cylinder.

5. The apparatus of claim 4, wherein said mixing element includes mixing blades which protrude essentially radially from said pump cylinder, said mixing blades also extending around said pump cylinder in a helical configuration.

6. The apparatus of claim 4, wherein:

said pump cylinder includes an axis of rotation and a bottom end distal to said drive means; and said mixing element includes a mixing ring disposed at the bottom end of said pump cylinder, said mixing ring also being disposed concentrically with said axis of rotation of said pump cylinder.

7. The apparatus of claim 1, wherein said mixing element is rotatably mounted within said pressure vessel apart from said pump cylinder.

8. The apparatus of claim 7, wherein said mixing element is rotatably driven by said pump cylinder via a releasable plug-in coupling that engages said pump cylinder with said mixing element.

9. The apparatus of claim 8, wherein:

said pump cylinder is movably mounted on said pressure vessel for displacement in an axial direction, said axial displacement including a first position wherein said pump cylinder is disposed partially outwardly of said pressure vessel and a second position wherein said pump cylinder is disposed within said pressure vessel; and said pump cylinder includes sealing means for sealing said pump cylinder within said pressure vessel in said second position.

10. The apparatus of claim 9, further comprising:

a removable stop for supporting said pump cylinder in said first position which prevents displacement of said pump cylinder into said second position.

11. The apparatus of claim 10, wherein said removable stop is formed by at least one holder which is pivotable into the path of displacement of said pump cylinder.

12. The apparatus of claim 11, further comprising:

means for releasably fastening said pump cylinder in said second position within said pressure vessel.

* * * * *